US006669516B1

(12) United States Patent
Husted et al.

(10) Patent No.: US 6,669,516 B1
(45) Date of Patent: Dec. 30, 2003

(54) WEED-RESISTANT OUTBOARD MOTOR DRIVE SYSTEM

(76) Inventors: Royce H. Husted, 1294 Elkton Farm Rd., Forest, VA (US) 24551; Joel P. Husted, 1293 Elkton Farm Rd., Forest, VA (US) 24551

( * ) Notice: Subject to any disclaimer, the term of this patent is extended or adjusted under 35 U.S.C. 154(b) by 0 days.

(21) Appl. No.: 10/224,163

(22) Filed: Aug. 20, 2002

(51) Int. Cl.[7] ..... B60L 11/02
(52) U.S. Cl. ..... 440/6
(58) Field of Search ..... 440/6

(56) References Cited

U.S. PATENT DOCUMENTS 486,684 A * 11/1892 Salisbury ..... 440/6
3,315,631 A * 4/1967 Bass ..... 440/6

* cited by examiner

*Primary Examiner*—Jesus D. Sotelo

(74) *Attorney, Agent, or Firm*—Nicholas A. Camasto LTD

(57) ABSTRACT

A weed and impact resistant outboard motor drive system includes a motor and a small diameter metallic propeller. An elongated flexible shaft is coupled between the motor and propeller. The flexible shaft is encased within a curved tubular housing that is secured to the motor at one end and carries a propeller shaft at its other end. The drive system is clamped to the boat with the motor above the boat and the propeller axis parallel to the water surface. A tangent to the curved tubular housing, as it enters the water, forms an acute included angle with the water surface that is no greater than 55°. The small in-the-water profile of the drive system and the angle of entry of the tubular housing into the water minimize weed pickup. The high speed rotation of the small diameter propeller facilitates cutting and churning through of any weeds that are picked up, while enabling proper trolling speeds. The low inertia of the drive system and the metallic propeller help to withstand contacts with rocks and the like. A tapered skeg is mounted to the tubular housing adjacent to the small propeller, extends beyond the blade tips of the propeller and has an angle of taper that is no greater than 55°.

20 Claims, 3 Drawing Sheets

WEED-RESISTANT OUTBOARD MOTOR DRIVE SYSTEM

BACKGROUND OF THE INVENTION

This invention relates to portable drive systems for shallow bottom boats, especially for such boats intended for operation in weed infested waters and/or in shallow waters with rocky beds.

It is well known that excellent fishing areas are often found in waters that may be weed infested and/or have shallow or rocky bottoms. Such conditions are impossible for conventional outboard motor drive systems and even very difficult for shallow draft trolling motor drive systems. In a conventional transportable trolling motor drive system, a small electric motor and propeller are suspended in the water by a steering handle mechanism that is removably supported by means of a bracket attached to the transom of a boat. Because of the drive system size and configuration, Le., the relatively large in-the-water profile of the motor, propeller and vertical support, weeds tend to catch. This drastically affects motor speed and efficiency and requires frequent stops to manually remove weed buildup. Since the diameter of the propeller is greater than the large diameter of the motor, the motor is operated at low rotation to provide proper low trolling speeds. The low motor rotation is not conducive to cutting and churning through weeds.

The weight of the motor also presents a problem. Because of the high inertia of the motor in the water, there is an increased possibility of propeller breakage or motor damage should obstacles be encountered. While there are systems described in the prior art for powering shallow draft boats under such conditions, they either involve significant modification of the boat transom or an unusual propulsion arrangement, such as fitting a propeller drive arrangement to an oar. Such systems have not found favor and none are known to be in use.

A practical shallow water, weed-resistant boat drive system should ideally: be lightweight; mount directly to a common boat transom; be readily transportable without requiring breakdown into component parts; present a minimal in-the-water profile; be capable of withstanding impacts with submerged articles; and have the ability to either shed, slice or churn through most weeds that are encountered.

As discussed above, the prior art systems fail to meet one or more of the above criteria. Drive systems that have the drive motor in the water do not present a minimal in-the-water profile, are ineffective in cutting, slicing or churning through weeds and are very susceptible to damage by impact with objects. Drive systems that have only a propeller in the water are very cumbersome, primarily due to the very long propeller shafts needed to achieve a favorable propulsion angle. None of the drive systems supports the propeller in the ideal position for weed resistance, ie., just beneath the water surface with the propeller axis parallel to the water surface.

U.S. Pat. Nos. 4,604,067 and 4,976,637 describe unusual trolling motor drive systems that utilize conventional hand-held, gasoline engine-powered weed cutting machines. The weed cutting machines include a bent tubular housing having a motor at one end and a rotating trimmer line cutting mechanism at the other end, with a flexible shaft, encased by the tubular housing, coupling the motor and the cutting mechanism. The cutting mechanism is replaced with a small propeller, and a clamping device is added to support the drive system from the transom of a boat. The bent tubular shaft, due to its radius of curvature, supports the propeller at an unfavorable propulsion angle in the water. The devices represent low cost trolling motor arrangements and, while exhibiting certain structural similarities, are not concerned with the problems addressed by the present invention and are clearly ineffective in operating in a weedy environment.

The present invention provides a motor drive system that meets all of the above described criteria and does so in a very simple, economical manner. It will be appreciated that others, such as hunters who use boats, often encounter similar weedy and shallow and/or rocky water conditions where the invention will be of significant benefit. The invention is also easily adapted for attachment to various inclined surfaces, such as the walls or gussets of a canoe, or for use on the bow of curved hull boat.

OBJECTS OF THE INVENTION

A principal object of the invention is to provide a novel motor drive system for a boat.

Another object of the invention is to provide a motor drive system that is capable of providing continuous operation of a boat in shallow rocky and/or weedy water.

A further object of the invention is to provide a lightweight, unitary portable weed and impact resistant motor drive system for a boat.

BRIEF DESCRIPTION OF THE DRAWINGS

These and other objects and advantages of the invention will be apparent upon reading the following description in conjunction with the drawings in which.

DETAILED DESCRIPTION OF THE INVENTION

Figure 1:
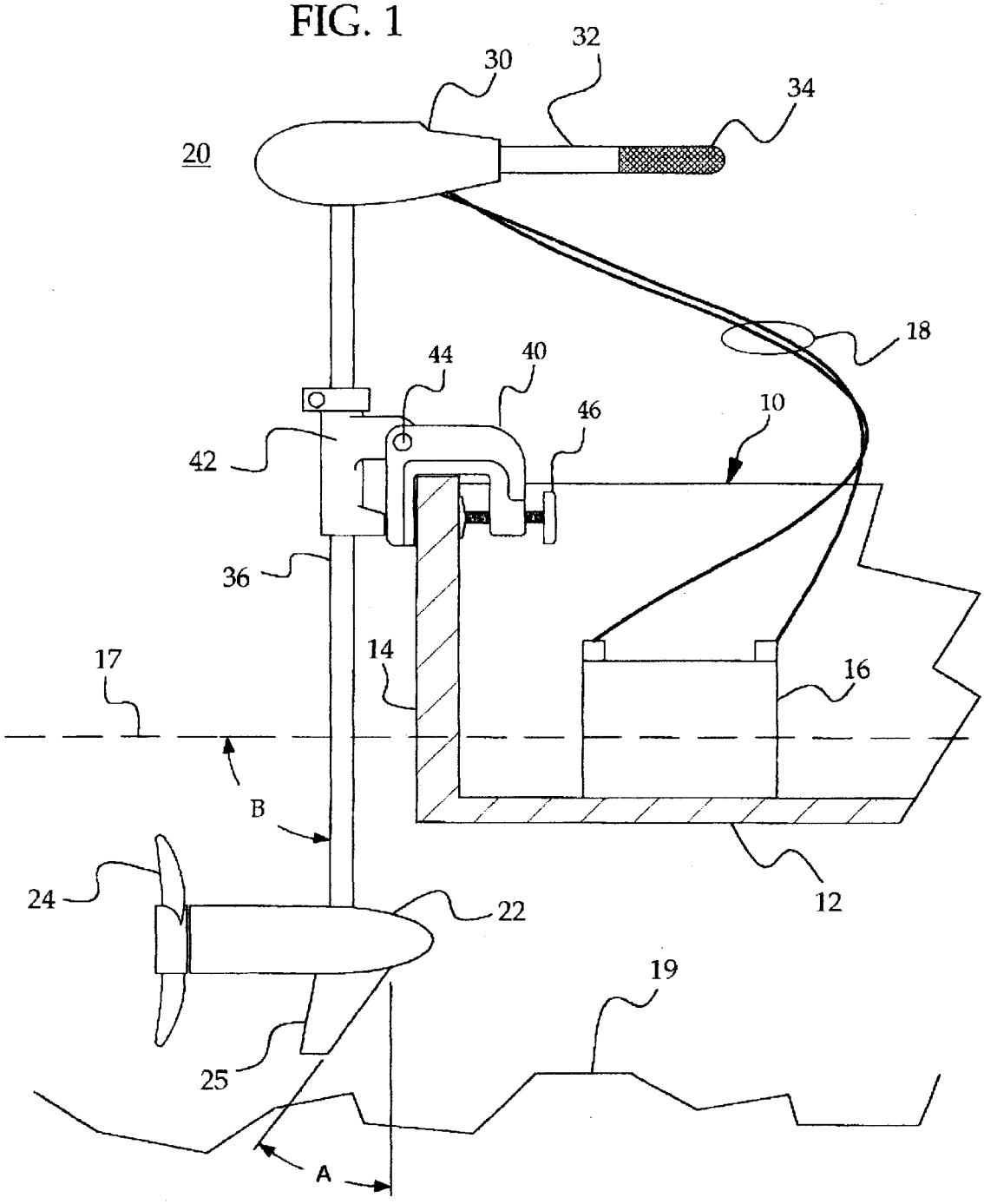
(Prior Art) FIG. 1
FIG. 1 is a simplified partial view of a prior art motor drive system for trolling with a shallow draft boat.

FIG. 1 discloses a partially illustrated shallow draft boat 10, having a bottom 12 and a substantially vertical transom 14, fitted with a prior art trolling motor drive system 20. Boat 10 draws very little water, and bottom 12 is shown as being just below the water surface or line 17. In practice, for smooth, quiet and efficient operation of the boat and its trolling motor system, the propeller tips should be at least two inches below the surface of the water. A battery 16 supplies power via electrical leads 18 for energizing motor drive system 20 in a well-known manner. While not essential, the applied power may be modulated, by well-known means (not shown) for controlling the speed of the motor, although for trolling, a slow steady boat speed is generally desired. Motor drive system 20 includes a D.C. motor 22 driving a propeller 24. A conventional control arrangement 30 (not shown in detail) is coupled to a steering handle 32, which terminates in a handle grip 34, and to a vertical portion 36 that is attached to motor 22. A U-shaped clamping bracket 40 supports a generally T-shaped bearing tube 42 at a pivot 44. The "T" portion of tube 42 rotatably supports vertical portion 36 and enables horizontal movement of motor 22 for steering. A screw clamp 46 removably secures bracket 40 (and drive system 20) to transom 14 of the boat. A skeg 23 is secured to the bottom of motor 22 to help provide impact protection for propeller 24 and includes a leading edge 23 that makes a relatively steep angle "A" with the water line 17.

It will be noted that the in-the-water profile of motor drive system 20 is quite substantial since motor 22 and propeller 24 are large. The part of vertical portion 36 that is in the water, not only presents significant resistance, but the angle of entry "B" of portion 36 to the water surface is 90°, which, as will be discussed in more detail below, is ideal for catching weeds, but of no use in shedding or churning through them. While motor 22 has a streamlined bullet shaped nose, it projects forwardly from vertical portion 36, thus forming a hook for catching and holding weeds. Propeller 24, as discussed, is relatively large and necessarily limits the depth of water in which the boat may be operated and increases the likelihood of encountering rocks or the bottom of the water. Similarly, the steep angle "A" of the leading edge 23 of skeg 25 is conducive to catching long stringy type weeds. Clearly, the prior art trolling motor drive system is not weed-resistant.

It will be observed that the weight of the prior art drive system is concentrated at a point removed from, and almost directly below, pivot 44, which results in the drive system having substantial inertia. If the motor or propeller of such a drive system encounters an obstruction or the shallow and/or rocky bottom 19, significant impact will be experienced and the likelihood of damage to the propeller or motor will be high. Further, the propeller is usually made of a hard plastic, which is readily broken upon impact. Since the propeller diameter is large (to clear the motor body), the motor speed must be low to maintain a desirable slow trolling speed for the boat. Therefore, weeds (especially long, stringy weeds) that are caught on the drive system tend to wrap around the motor and propeller shaft, rather than being cut off or shed, which places a heavy drag on the motor, necessitating frequent stops to manually remove weed buildup.

Figure 2:
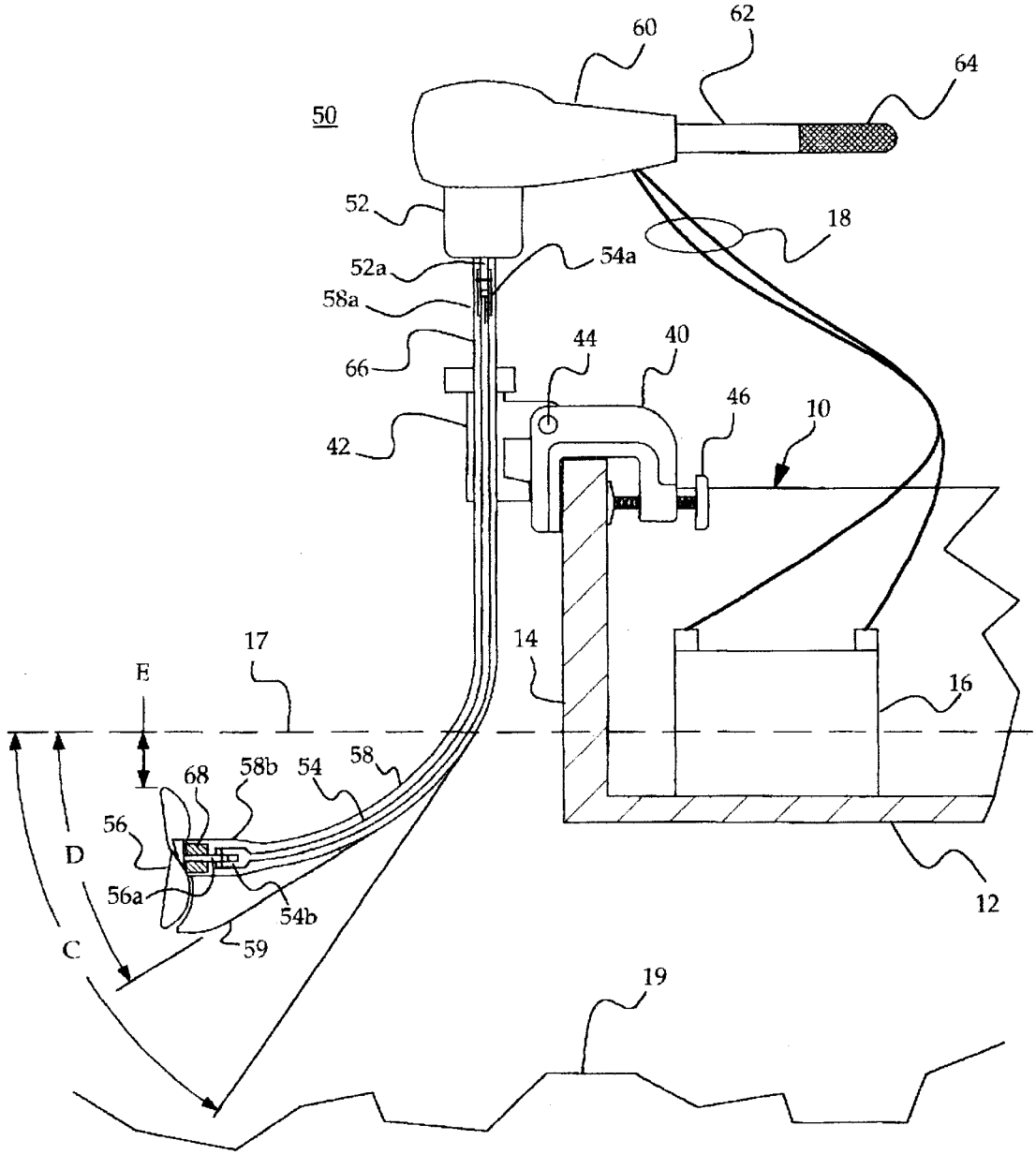
FIG. 2 is a similar simplified view of the motor drive system of the invention applied to such a boat.

On the contrary, the motor drive system 50 of the invention illustrated in FIG. 2 overcomes these prior art problems. The boat 10, battery 16 and T shaped bearing tube 42 that is supported by clamping bracket 40 at pivot 44 are the same as in the prior art FIG. 1. A control arrangement 60, which includes a horizontal handle 62 that terminates in a handle grip 64 is similar in function to the prior art and is not be separately illustrated since it is not germane to this invention. A significant difference between the inventive arrangement and the prior art is a vertically oriented motor 52 that is situated outside the water and above pivot 44. With this arrangement, the inventive drive system exhibits an inertia that is significantly less than the prior art system. It should be noted that the vertical orientation of motor 52 is not an essential part of the invention, but rather simplifies the construction of the inventive drive system.

Another significant difference is the provision of a curved tubular housing 58 and an elongated flexible shaft 54 encased therein. The tubular housing has a proximal end 58*a* and a slightly enlarged distal end 58*b*. Flexible shaft 54 is coupled to a motor 52 at a proximal end 54*a* and is coupled to the propeller shaft 56*a* of a small propeller 56, at a distal end 54*b*. Tubular housing 58 includes a straight vertical portion 66, secured in bearing tube 42, that extends from proximal end 58*a* through a large sweeping arc of 90° to distal end 58*b*. The proximal end 58*a* of tubular housing 58 may be secured to motor 52 by a flange 52*a* or any suitable means. The proximal end 54*a* of flexible shaft 54 has a square fitting that nests with a mating fitting (neither of which fitting is shown) on motor 52. The coupling may be similar to a speedometer drive arrangement and is not illustrated. The distal end 54*b* of flexible shaft 54 is coupled to propeller shaft 56*a* by a pin and slotted shaft arrangement 54*c*, which is illustrative only, since the method of attachment is not germane to the invention. The distal end 58*b* of tubular housing 58 terminates in a conventional pressed-in bearing/seal 68 for permitting rotation of propeller shaft 56*a* while keeping water out of tubular housing 58, which is conventionally filled with grease for flexible shaft 54.

To assemble the arrangement shown, propeller shaft 56*a* is coupled to the distal end 54*b* of flexible shaft 54, via coupling 54*c* and inserted into the distal end of tubular housing 58. The bearing/seal 68 is pressed into the distal end of tubular housing 58, the square proximal end 54*a* of flexible shaft 54 is engaged with the fitting on motor 22, and flange 52*a* secured to motor 22. The propeller 56 is then secured to propeller shaft 56*a*.

An important aspect of the invention is the angle of entry of tubular housing 58 in the water. Experimentation with different types of weeds has shown that the included angle "C", which is formed by a tangent drawn to the curve of the tubular housing at the water surface or line, should be no greater than 55°, and ideally less than 45°, to provide any significant weed shedding ability. Also, as mentioned previously, propeller 56 has a relatively small diameter which enables it to be operated at much higher rotational speed than prior art systems while still maintaining a desired slow trolling speed for the boat. The propeller 56 is of the so called "weed free" type, the blades of which have a retreating radius, i.e., the leading edges of the blades are drafted back from the direction of rotation of the propeller, which together with the propeller speed, enables efficient cutting and churning through of any weeds presented to it.

For proper operation of the propeller in the water, its blade tips should be a distance "E" of at least two inches below the surface of the water. At lesser distances, cavitation and noise result and the system becomes very inefficient, as well as useless for trolling. Further benefit in weed shedding ability, as well as protection for the propeller, is obtained by providing a thin skeg 59 that extends beyond the blade tips of the propeller and that makes an angle "D" with the water line or surface that is no greater than the angle "C". It has been found that with this configuration, long stringy weeds are directed downwardly along the curved portion of tubular housing 58 and by the angled leading edge of skeg 59 to propeller 56 (which also prevents the weeds from being wound around the propeller) where they are sliced and shed as discussed above. Lastly, the combination of the skeg, placement of the motor above the hinge point (pivot 40) and the distance of propeller 56 farther behind the hinge point results in significantly less shock to, and movement of; the motor should underwater obstacles be encountered.

Figure 3:
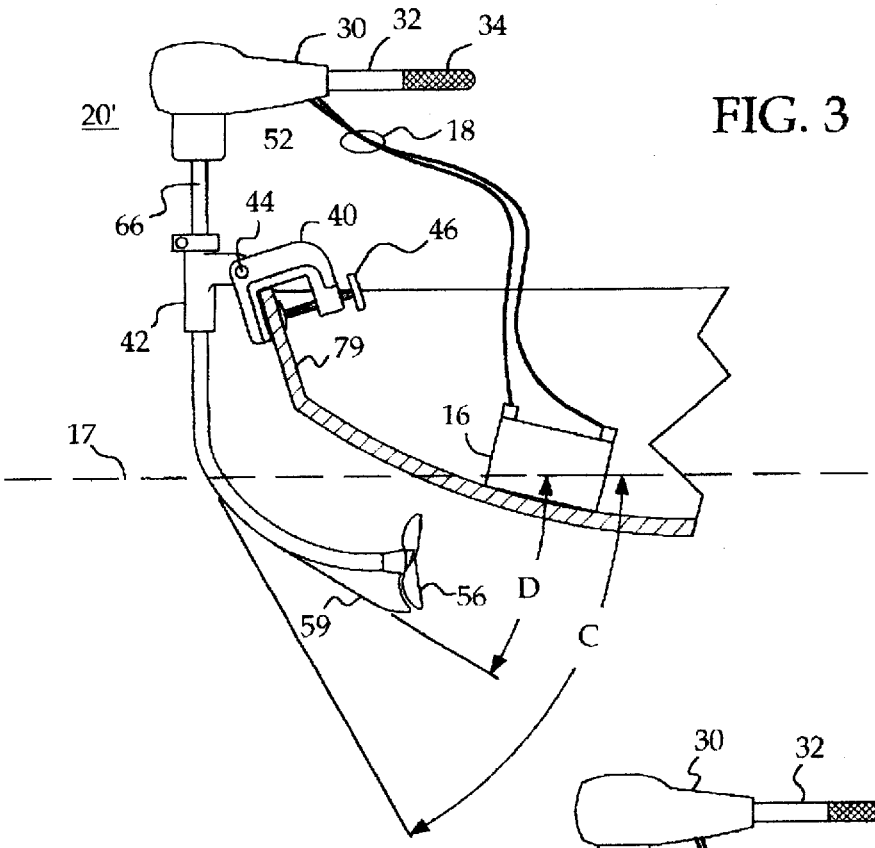
FIG. 3 illustrates the invention in use on the bow of such a boat.

FIG. 3 discloses the drive system of the invention in use on the bow of a curved hull boat. Everything is the same as that shown in FIG. 2, except that tubular housing 58 has been rotated 180 so that propeller 56 is under the bow of the boat, rather than being positioned at the stern of the boat. Clamping bracket 40 readily accommodates installation on a non-vertical portion 79 of the bow. Operation of the inventive drive system is the same as that previously described for FIG. 2.

Figure 4:
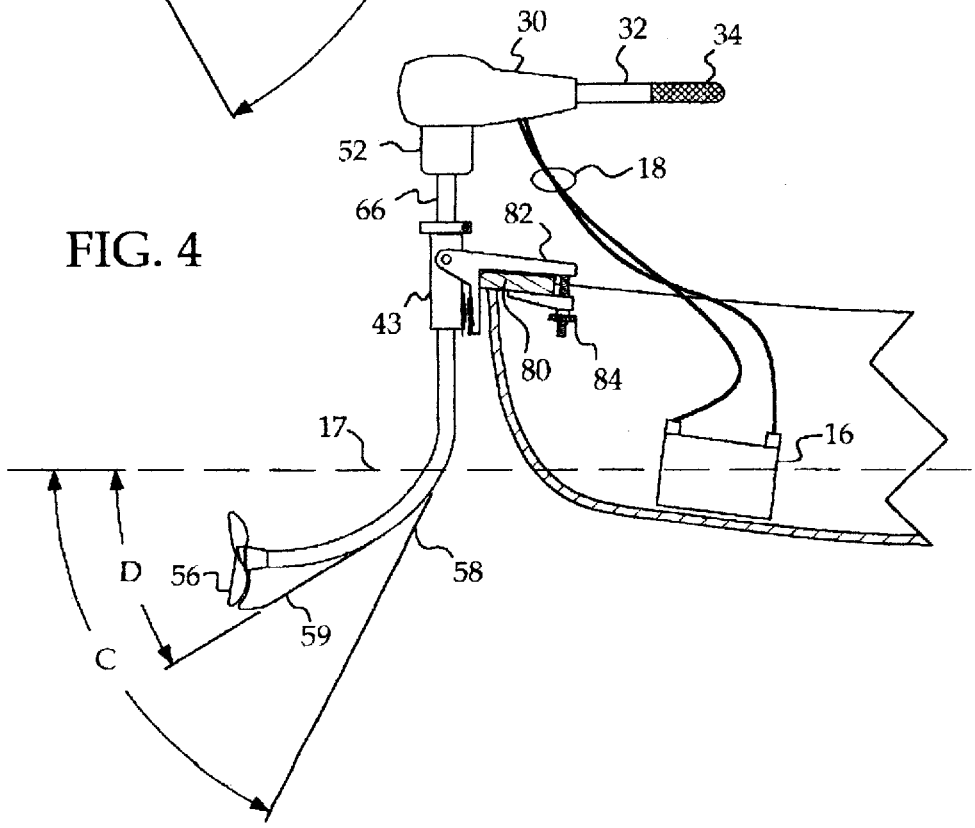
FIG. 4 depicts a simplified arrangement of the drive system of the invention applied to a canoe.

In FIG. 4, the drive system of the invention is shown in use with a canoe that includes a horizontal stern piece or gusset 80. A modified bearing tube 43 supports a pivoted clamping bracket 82 that engages the top of stem piece 80. The drive system is removably secured to the canoe by a screw-type clamp arrangement 84. It will be appreciated that the mounting arrangement is merely illustrative of a typical installation and may be readily changed to suit a desired installation. The remainder of the inventive drive system is identical in use and operation to that previously described.

What has been described is a novel portable low speed outboard motor drive system for use with shallow bottom boats, that resists weed buildup, has significant impact resistance and is especially suitable for slow speed boating in weedy and shallow/rocky bottom waters. It is recognized that numerous changes to the described embodiment of the invention will be apparent to those skilled in the art without departing from its true spirit and scope. The invention is to be limited only as defined in the claims.

What is claimed is:

1. A weed and impact resistant outboard motor drive system comprising:

a motor;

a small propeller;

an elongated flexible shaft having a proximal end coupled to said motor and a distal end coupled to .said small propeller;

a curved tubular housing, enclosing said flexible shaft, and having one end secured to said motor and its other end supporting said small propeller;

a mounting bracket, for removably clamping said drive system to a boat;

a tapered skeg, extending beyond the diameter of said small propeller, mounted to said tubular housing adjacent to said small propeller;

said curved tubular housing supporting said small propeller for rotation below, and with its axis substantially parallel to the water surface, and with a tangent to said curved tubular housing, at the point of entry into the water, forming an acute included angle with said water surface; so that the curved portion of said curved tubular housing is at the waterline when in normal operating position; and said curved tubular housing having the portion secured to said motor extending substantially perpendicular to said water.

2. The drive system of claim 1, wherein said small propeller and said tubular housing present a small in-the-water profile.

3. The drive system of claim 2, wherein said small propeller has a minimal diameter for permitting high speed rotation thereof during trolling to aid in the cutting and churning through of weeds.

4. The drive system of claim 3, wherein the angle of taper of said tapered skeg is no greater than said acute included angle.

5. The drive system of claim 4, wherein said small propeller is made of metal for enhanced cutting of weeds and impact resistance.

6. The drive system of claim 5, further including a steering handle on said motor and a bearing on said mounting bracket for enabling movement of said handle and said motor in a horizontal plane.

7. The drive system of claim 5 further including a hinge between said motor and said mounting bracket for enabling movement of said motor in a vertical plane.

8. The drive system of claim 1, wherein said acute included angle is 55° or less.

9. The drive system of claim 1 wherein said small propeller has its leading blade edges drafted back from the direction of rotation for cutting and churning through of weeds.

10. A weed and impact resistant outboard motor drive system comprising:

a motor;

a small propeller;

an elongated flexible shaft having a proximal end coupled to said motor and a distal end coupled to said small propeller;

a curved tubular housing, enclosing said flexible shaft, and having one end secured to said motor and its other end supporting said small propeller;

said small propeller and said tubular housing presenting a small in-the-water profile;

said small propeller having a minimal diameter for permitting high speed rotation thereof during trolling to aid in the cutting and churning through of weeds a mounting bracket, for removably clamping said drive system to a boat;

a tapered skeg mounted to said tubular housing adjacent to said small propeller extending beyond the diameter of said small propeller;

said curved tubular housing supporting said small propeller for rotation below, and with its axis substantially parallel to, the water surface, and with a tangent to said curved tubular housing, at the point of entry into the water, forming an acute included angle with said water surface; so that the curved portion of said curved tubular housing is at the waterline when in normal operating position;

the angle of taper of said tapered skeg being no greater than said acute included angle; and said curved tubular housing having the portion secured to said motor extending substantially perpendicular to said water.

11. The drive system of claim 10, wherein said small propeller is made of metal for enhanced cutting of weeds and impact resistance.

12. The drive system of claim 11, further including a steering handle on said motor and a bearing on said mounting bracket for enabling movement of said handle and said motor in a horizontal plane.

13. The drive system of claim 12 further including a hinge between said motor and said mounting bracket for enabling movement of said motor in a vertical plane.

14. The drive system of claim 13, wherein said acute included angle is 55° or less.

15. The drive system of claim 14 wherein said handle is reversible for use on the bow of a boat.

16. The drive system of claim 13, wherein said mounting bracket includes a universal clawing means for securing to various inclined surfaces, such as the walls or gussets of a canoe.

17. An outboard motor drive system for use in shallow and/or weedy water comprising:

a motor having an output shaft;

a small propeller having a propeller shaft;

a bent tubular housing with a straight proximal end section mounted on center with said motor and continuing through a bend to a distal end;

a flexible shaft rotatably supported within said bent tubular housing and coupled to said motor output shaft at its proximal end and coupled to said propeller shaft at its distal end;

a bearing secured at the distal end of said tubular housing for rotatably supporting said propeller shaft;

a tapered elongated skeg mounted to said bent tubular housing adjacent to said small propeller;

a mounting bracket for clamping said drive system to a boat;

a steering hinge hingeably connecting said drive system to said mounting bracket;

a steering handle, attached to said drive system;

the bent portion of said bent tubular housing extending into the water with a smooth broad radius, the tangent of which, at no point below the water surface forms an included angle greater than 55° to said water surface as it supports said small propeller parallel to said water surface and with the blade tips of said small propeller submerged at least two inches below said water surface; so that the curved portion of said curved tubular housing is at the waterline when in normal operating position; and said curved tubular housing having the portion secured to said motor extending substantially perpendicular to said water.

18. The drive system of claim 17 with said skeg extending tangentially from said tubular housing to a depth greater than the radius of said small propeller.

19. The drive system of claim 18, wherein said mounting bracket includes a hinge for rotating said drive system out of the water on a vertical plane.

20. The drive system of claim 19 wherein said small propeller has its leading blade edges drafted back from the direction of rotation for cutting and churning through of weeds.

* * * * *